US009523249B2

(12) United States Patent
Binder et al.

(10) Patent No.: US 9,523,249 B2
(45) Date of Patent: Dec. 20, 2016

(54) PIPE RACK AND METHOD FOR FEEDING AND REMOVING TUBULAR BODIES TO AND FROM A DRILLING INSTALLATION

(71) Applicant: HERRENKNECHT VERTICAL GMBH, Schwanau (DE)

(72) Inventors: Jürgen Binder, Lahr-Sulz (DE); Andrej Nadan, Ettenheim (DE)

(73) Assignee: HERRENKNECHT VERTICAL GMBH, Schwanau (DE)

( * ) Notice: Subject to any disclaimer, the term of this patent is extended or adjusted under 35 U.S.C. 154(b) by 27 days.

(21) Appl. No.: 14/394,249

(22) PCT Filed: Apr. 15, 2013

(86) PCT No.: PCT/EP2013/001100
§ 371 (c)(1),
(2) Date: Feb. 7, 2015

(87) PCT Pub. No.: WO2013/156133
PCT Pub. Date: Oct. 24, 2013

(65) Prior Publication Data

US 2015/0167407 A1 Jun. 18, 2015

(30) Foreign Application Priority Data

Apr. 16, 2012 (DE) ..... 10 2012 007 402

(51) Int. Cl.
*E21B 19/14* (2006.01)
*E21B 19/15* (2006.01)

(52) U.S. Cl.
CPC ..... *E21B 19/14* (2013.01); *E21B 19/155* (2013.01)

(58) Field of Classification Search
CPC ..... E21B 10/155; E21B 19/00; E21B 19/15; E21B 19/14
(Continued)

(56) References Cited

U.S. PATENT DOCUMENTS 3,212,593 A * 10/1965 Reischl ..... E21B 19/14 175/85
4,371,302 A * 2/1983 Frias ..... E21B 19/155 414/22.61
(Continued)

FOREIGN PATENT DOCUMENTS

CA 1247590 A * 12/1988 ..... E21B 19/15
CA 2419885 A1 * 8/2003 ..... E21B 19/155
(Continued)

*Primary Examiner* — Jeanette E Chapman
(74) *Attorney, Agent, or Firm* — Mark Rodgers

(57) ABSTRACT

The invention relates to a pipe store for supplying and discharging pipe bodies, in particular drill rods, casing pipes, and/or drill-string parts, such as drill collars, drilling motors or the like, to and from a drilling rig for creating deep wells, having a basic structure, having at least one framework which is provided in the form of a transporting and storage framework for pipe bodies and in which a plurality of pipe bodies are arranged to form a load, and having a removal apparatus for removing the pipe bodies from the framework and supplying the pipe bodies into the framework, characterized in that the basic structure has at least two accommodating portions for accommodating the framework in an essentially horizontal arrangement, in that, following insertion into the accommodating portion, the framework is fastened in a rotatable manner therein, and can be transferred from a horizontal orientation into a vertical orientation by means of a lifting element, in that each of the pipe bodies can be individually removed from the framework, or inserted into the same, in the vertical position by the removal apparatus, and in that the removal apparatus can be displaced along the basic structure in front of the individual portions.

7 Claims, 13 Drawing Sheets

Figure 1:
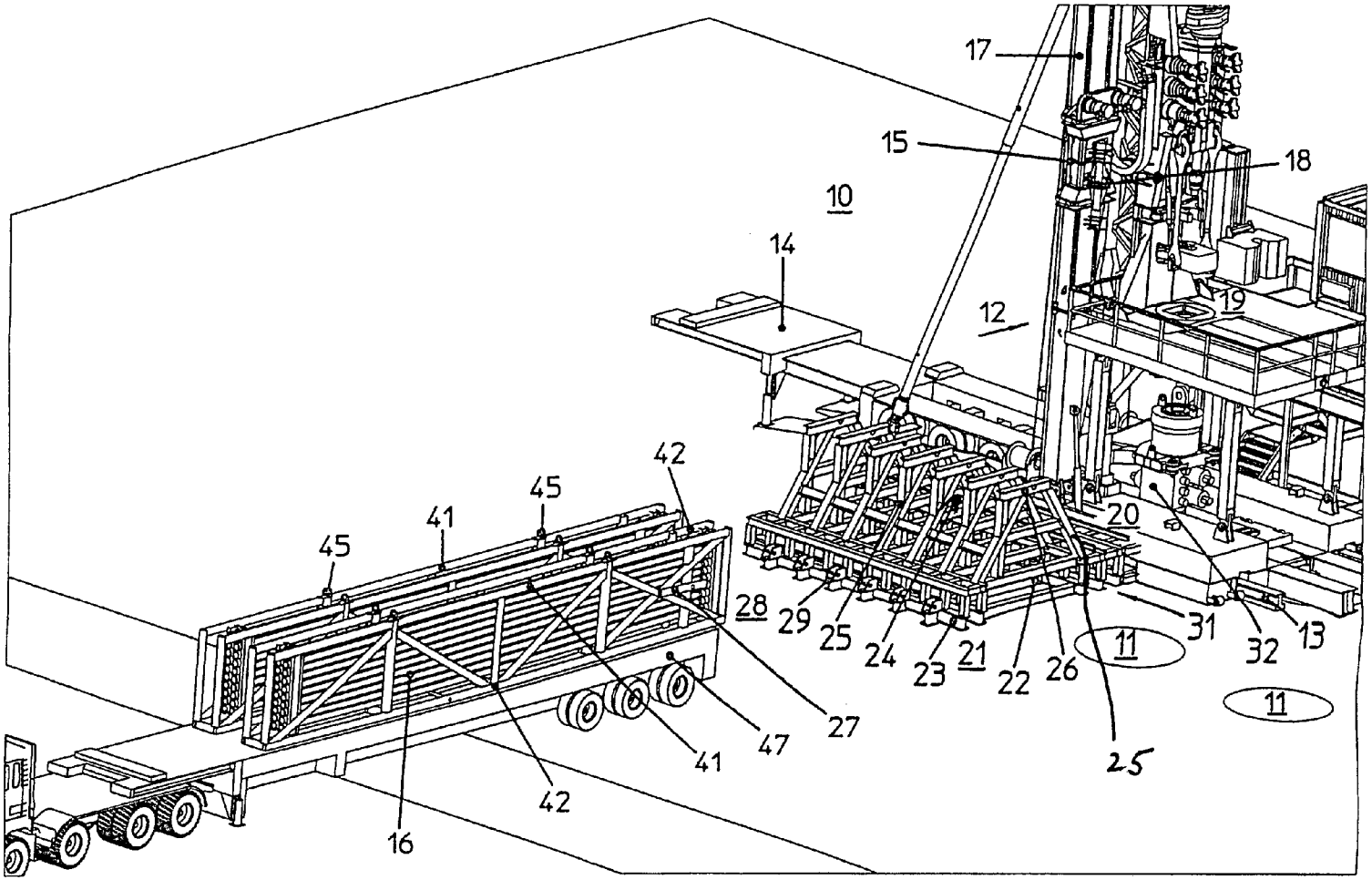

(58) Field of Classification Search
USPC ..... 414/22.51–22.59, 22.61–22.69, 22.71; 211/70.4
See application file for complete search history.

(56) References Cited

U.S. PATENT DOCUMENTS

| | | | | | |
|---|---|---|---|---|---|
| 4,453,872 | A * | 6/1984 | Frias | E21B 19/15 | 198/719 |
| 4,718,805 | A * | 1/1988 | Becker | E21B 19/155 | 175/85 |
| 5,375,667 | A | 12/1994 | Trevisani | | |
| 5,451,129 | A * | 9/1995 | Boyadjieff | B65G 1/0442 | 414/22.61 |
| 6,425,709 | B1 * | 7/2002 | Frijns | B23K 37/0533 | 228/49.1 |
| 6,763,898 | B1 | 7/2004 | Roodenburg | | |
| 8,419,335 | B1 * | 4/2013 | Orgeron | E21B 19/155 | 212/255 |
| 8,490,718 | B2 * | 7/2013 | Lunde | E21B 19/14 | 175/52 |
| 8,905,160 | B1 * | 12/2014 | Verzilli | E21B 19/155 | 175/203 |
| 9,157,286 | B2 * | 10/2015 | Richardson | E21B 19/14 | |
| 2009/0053015 | A1 * | 2/2009 | Zachariasen | E21B 19/14 | 414/22.66 |
| 2009/0279987 | A1 * | 11/2009 | Jantzen | E21B 19/155 | 414/22.53 |
| 2010/0239404 | A1 | 9/2010 | Blanchard | | |
| 2012/0103623 | A1 * | 5/2012 | Wijning | E21B 19/146 | 166/352 |

FOREIGN PATENT DOCUMENTS

| | | | | |
|---|---|---|---|---|
| CA | 2661631 | A1 | 10/2010 | |
| EP | 548900 | A2 * | 6/1993 | E21B 19/14 |
| EP | 1953334 | A2 | 8/2008 | |
| WO | WO2004/035985 | A1 | 4/2004 | |
| WO | WO2006073312 | A2 | 7/2006 | |
| WO | WO2012025804 | A1 | 3/2012 | |

* cited by examiner

PIPE RACK AND METHOD FOR FEEDING AND REMOVING TUBULAR BODIES TO AND FROM A DRILLING INSTALLATION

The invention relates to a pipe store for supplying and discharging pipe bodies, in particular drill rods, casing pipes, and/or drill-string parts, such as drill collars, drilling motors or the like, to and from a drilling rig for creating deep wells, having a basic structure, having at least one framework which is provided in the form of a transporting and storage framework for pipe bodies and in which a plurality of pipe bodies are arranged to form a load, and having a removal apparatus for removing the pipe bodies from the framework and supplying the pipe bodies into the framework, and to a method of supplying and discharging pipe bodies.

The operation of creating deep wells, for example for exploiting crude oil and natural gas or for generating energy from geothermal sources, makes use of a drilling tool which is driven via a drill string comprising drill-pipe assemblies and drill-string parts, such as drill collars, drilling motors or the like. As drilling as such progresses, it is necessary for further drill rods to be added to the drill strings once a certain amount of drilling progress has been achieved. These drill rods are supplied from outside. For this purpose, a pipe store is provided alongside the drilling rig.

It is also necessary, during the operation of creating the deep well, for the drilling tool to be changed over, either because it has become worn or because the geological conditions have changed, and therefore a different type of tool is necessary. In order to change over the drilling tool, it is necessary for the entire drill string to be removed from the drillhole and, once a new drilling tool has been provided, to be re-installed. For this purpose, for example in large rigs, drill rods of the drill-pipe assembly are removed and installed two or three at a time and are set down in an upright state in the derrick of the drilling rig. If this store in the derrick is full, then the drill rods which are yet to be removed or installed have to be removed from the drilling rig. In the case of small rigs without any facility for setting down pipes in the derrick, the drill rods are positioned directly in the pipe store.

A known embodiment provides a pipe store which is connected to the drilling rig via a slanting plane. The drill-pipe assembly is transported into the drilling rig via said slanting plane, by means of a lifting apparatus, and is then supplied to the drilling rig, and installed, by the lifting apparatus. This procedure is associated with a high level of manual work and risk of injury. Furthermore, having the storage site for the drill rods outside the drilling rig usually means a large drilling site, which is not necessarily advantageous for certain applications.

Offshore rigs also have the problem that possibly the masts of the drilling rig as such are not particularly large or solid. This is also the case in drilling rigs which serve for exploration, and are arranged, for example, on jack-up rigs or ships. The problem here is that it is not possible for sufficiently large numbers of drill rods to be set down in the mast of the drilling rig and that said drill rods have to be removed from the drilling rig when weather conditions worsen. This is the case in particular for drilling rigs which are arranged on cantilever platforms.

The same also applies to rigs which are mobile. In this case, for weight reasons, it is likewise necessary for the drill rods to be positioned outside the rig at least when the rig is skidding to the next drilling site.

It is therefore an object of the invention to provide a pipe store by means of which a drilling rig can be easily supplied, reliably and quickly, with pipe bodies in automated fashion with low maintenance requirements.

It is has also been found that, in particular in the case of drilling rigs which are used in confined conditions, such as for example exploration rigs, or in the case of rigs with drilling sites close together, the overall procedure of storing the drill rods in relation to the drilling rig and in respect of storage location, supplying and discharging the drill rods from the storage location to the drilling rig, and in particular the storage of the drill rods in relation to the operation of installing and removing a drilling bit, is worthy of improvement as a whole. It is therefore also an object of the invention to provide a system and a method in which the drill rods can be easily and reliably supplied to the drilling rig and discharged, in particular in confined space conditions.

The object is achieved according to the invention by a pipe store in which the basic structure has at least two accommodating portions for accommodating the framework in an essentially horizontal arrangement, in that, following insertion into the accommodating portion, the framework is fastened in a rotatable manner therein, and can be transferred from a horizontal orientation into a vertical orientation by means of a lifting element, in that each of the pipe bodies can be individually removed from the framework, or inserted into the same, in the vertical position by the removal apparatus, and in that the removal apparatus can be displaced along the basic structure in front of the individual portions.

It is advantageous here that it is possible, by virtue of the design of the pipe store, for the pipe store to be handled completely vertically, which constitutes a considerable simplification and cuts back on energy, since it is not necessary for each pipe body to be transferred from the necessary vertical position into the horizontal position.

A further teaching of the invention provides that the lifting element is arranged with one side at the basic structure and the other side at the framework. This allows the erecting operation to be carried out without an additional lifting apparatus such as an external crane.

A further teaching of the invention provides that the removal apparatus has a vertically active lifting element, via which the pipe body can be raised, wherein the vertically active lifting element can be displaced preferably horizontally away from the removal apparatus. This allows separation from the framework to take place in a reliable manner.

A further teaching of the invention provides that the removal apparatus has a horizontally active retaining and/or gripping element, wherein the vertically active retaining and/or gripping element can be displaced preferably horizontally away from the removal apparatus. This renders reliable vertical transportation possible.

A further teaching of the invention provides that an engagement region, in which the removal apparatus actively engages, is provided in the accommodating portion, beneath the framework. It has been found that the operation of lifting out from beneath can be realized in a particularly easy and low-maintenance manner.

A further teaching of the invention provides a control means, via which it is possible to control the removal or the addition of the pipe bodies, wherein preferably individual accommodating portions can be blocked by the control means. This makes it possible for frameworks to be supplemented or removed during operation. It is also advantageous to provide a plurality of accommodating means, this rendering continuous operation possible.

A further teaching of the invention provides that the pipe store is arranged on rails and can skid with frameworks provided in the accommodating portions.

A further teaching of the invention provides that the removal apparatus can be displaced between an accommodating/discharging position in front of the accommodating portions and a transfer/receiving position for transferring the pipe body to a pipe handler or for receiving the pipe body from a pipe hander. This allows the operation to be automated.

In respect of the method, the object of the invention is achieved by a method in which the pipe bodies are arranged in a framework to form a load, the framework is supplied to a pipe store essentially horizontally and is arranged in an accommodating portion of the pipe store such that it can be rotated about a horizontal axis of rotation, the framework is then raised in the pipe store from an essentially horizontal position into a vertical position and arrested, and in each case a vertical pipe body is removed from the vertical framework by a removal apparatus and is transferred to a pipe handler, which supplies the pipe body to the drilling region.

A further teaching of the invention provides a control means, wherein preferably the pipe bodies and/or the frameworks are recorded in an inventory and particularly preferably the control means takes account of the inventory.

A further teaching of the invention provides that the pipe bodies in the framework are arranged to form the load prior to being supplied to the drilling location.

A further teaching of the invention provides that the pipe body is raised from beneath, and removed from the framework, by the removal apparatus.

A further teaching of the invention provides that the framework is raised from an essentially horizontal position into a vertical position with the aid of a lifting element, preferably a hydraulic cylinder or a rack, provided on the pipe store.

The invention will be explained in more detail hereinbelow with reference to a preferred exemplary embodiment and in conjunction with the drawings, in which:

FIGS. 1 to 13 show the pipe store according to the invention in conjunction with the individual steps of the method according to the invention.

Individual drilling sites 11 are provided at a drilling location 10. A drilling rig 12, which can skid on rails 13, is arranged above a drilling site 11. The drilling rig 12 is designed in the form of a hydraulic drilling rig and is arranged on a flat-bed truck 14. A pipe handler 15 for handling upright drill rods 16 is provided. The pipe handler 15 comprises a carrier 17, on which the gripping unit 18 can be displaced in height. The gripping unit 18 can be pivoted between the drilling region 19 and a transfer point 20 of a pipe store 21.

The pipe store 21 comprises a basic body 22, which is mounted for skidding on rails 23. Accommodating portions 24 are provided above the basic body 22 and are each bounded, on two opposite sites, by a vertical carrier structure 25. The carrier structure 25, at its upper end, has an accommodating means 26, in which an arresting and rotary element 27 can be arranged. Accommodating means 29, to which a hydraulic cylinder 30 can be fitted, are provided on a side 28 of the pipe store 21, said side being directed away from the drilling rig 12. The accommodating portions 24 are designed to be open at the sides 28, 31, between the carrier structures 25.

A removal apparatus 33 is arranged between the side 31, which is directed toward the drilling rig, and the site of contact 32 of the drilling rig 12. Said removal apparatus can travel on rails 34. It comprises a base portion 35, which also comprises the traveling-gear mechanism (not illustrated) on the rails 34. The base portion 35 has arranged on it a carrier 36, at the upper end of which a holder unit 37 is provided. The base portion 35 has provided in it a telescopic extension arm 38 at the end of which is provided a removal element 39, which is moved vertically via a hydraulic cylinder 40.

The drill rods 16 are provided in a transporting and storage framework 41. The transporting and storage framework 41 comprises, on either side, a frame 42 on which the arresting and rotary element 27 is arranged. Provided within the frame 42 are arrangement elements 43, which have depressions 44, in which the drill rods 16 are provided. Depending on the design of the arrangement elements 43, it is possible for one or more rows of drill rods 16 to be provided within a transporting and storage framework 41. Lifting-means attachments 45 are provided on the upper side 51 of the transporting and storage framework 41. An accommodating means 46 for attachment of the hydraulic cylinder 30 is provided on the underside of the transporting and storage framework 41.

Figure 2:
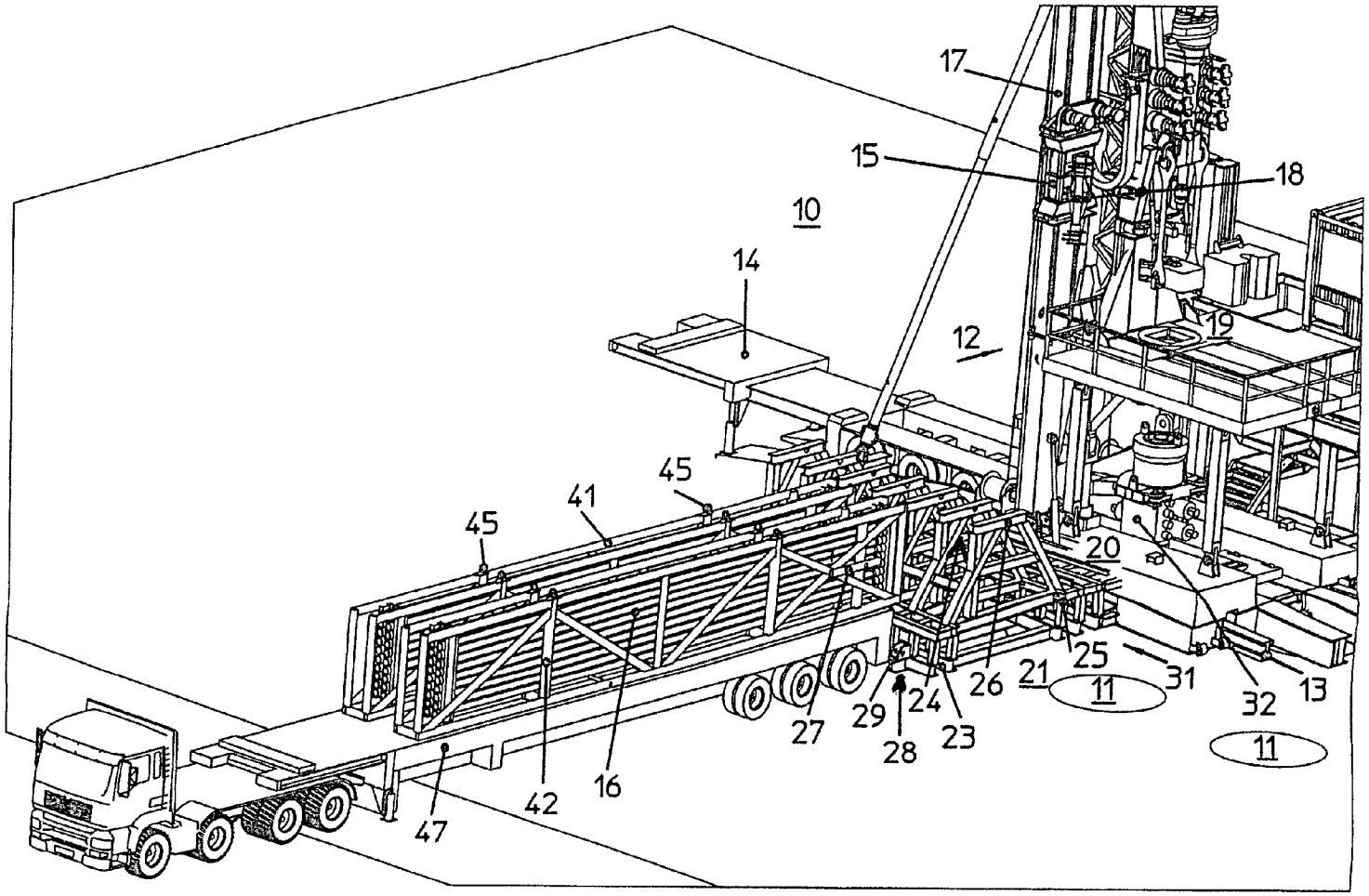
Figure 3:
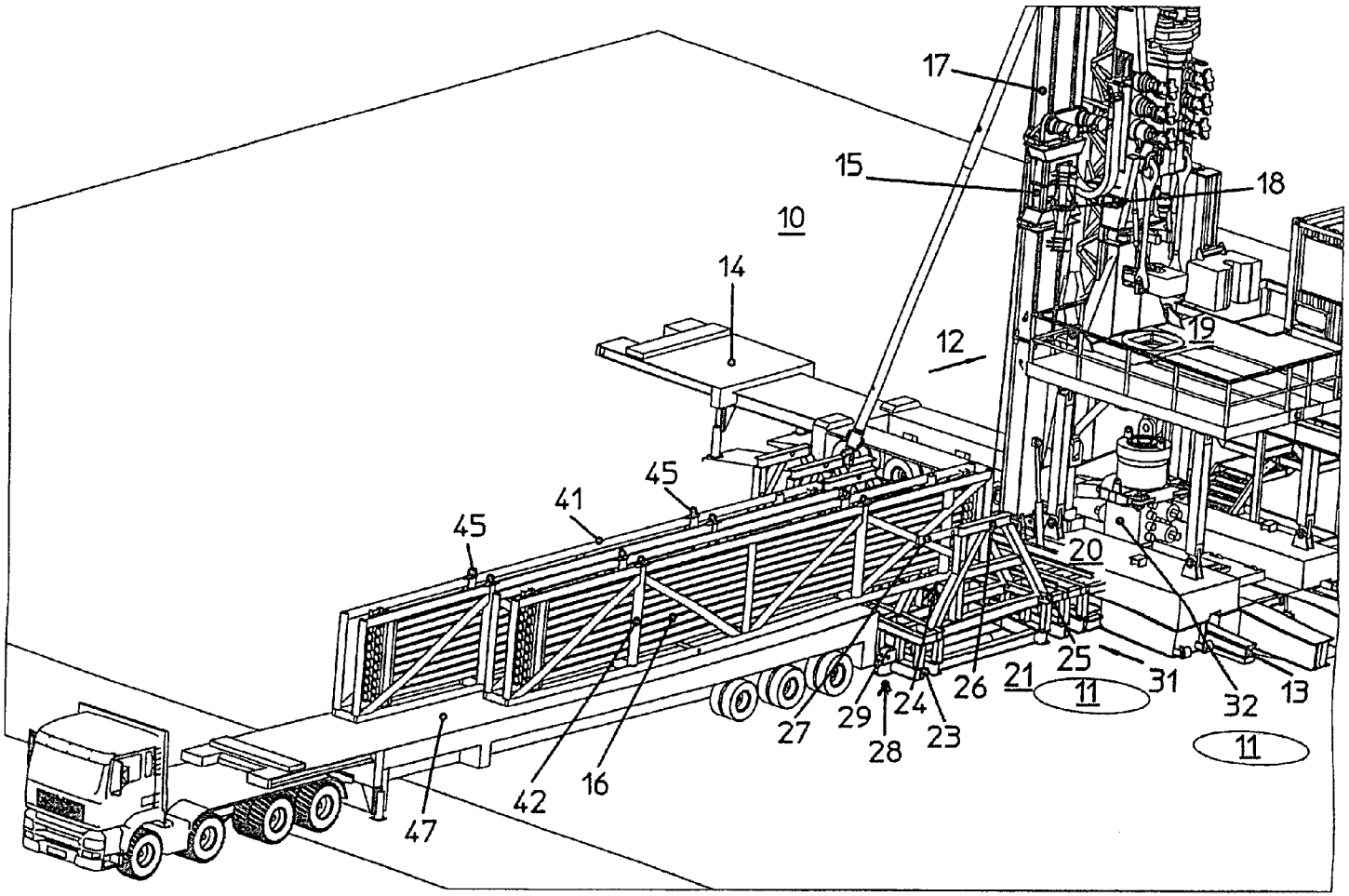
Figure 4:
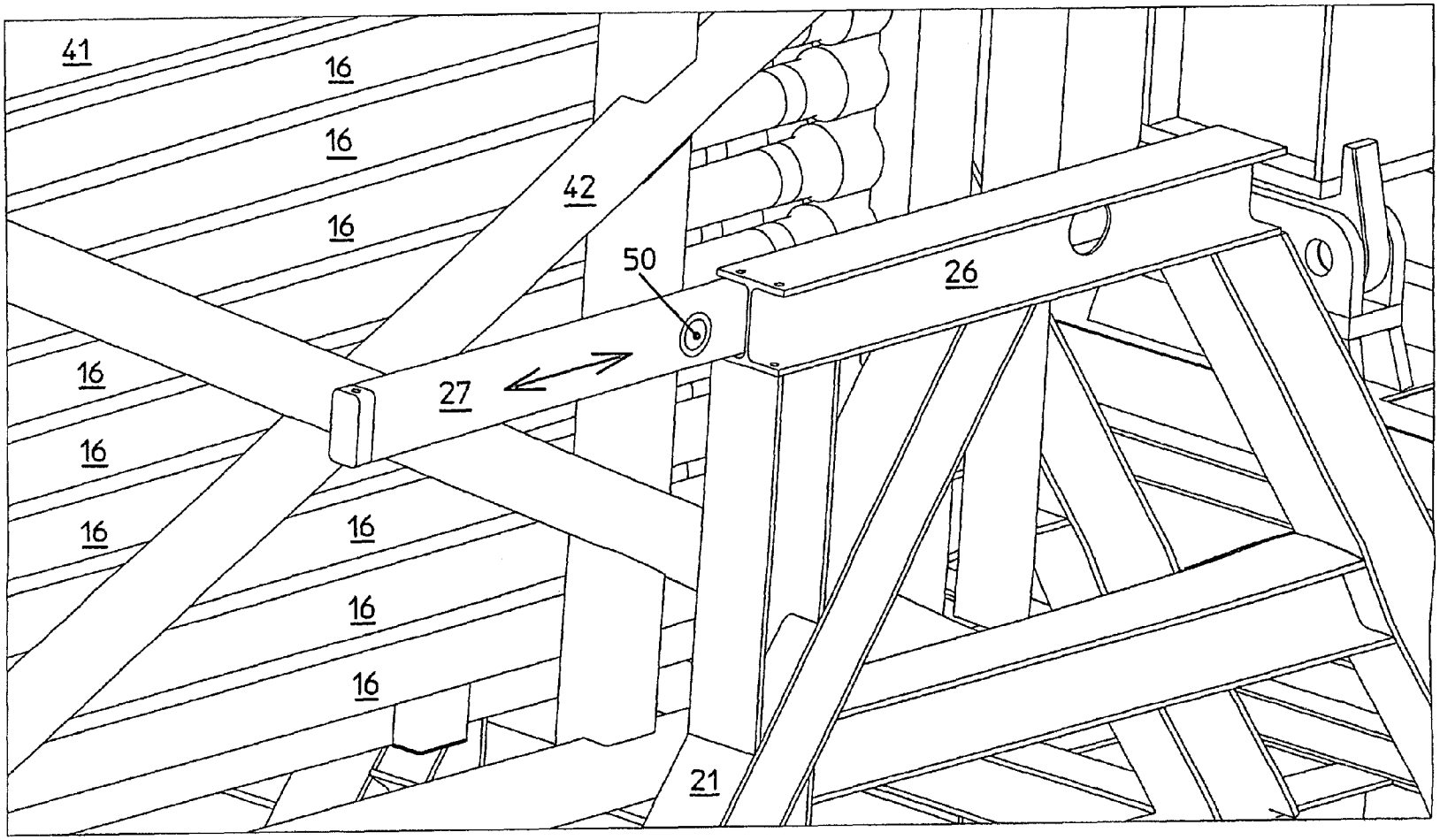
Figure 5:
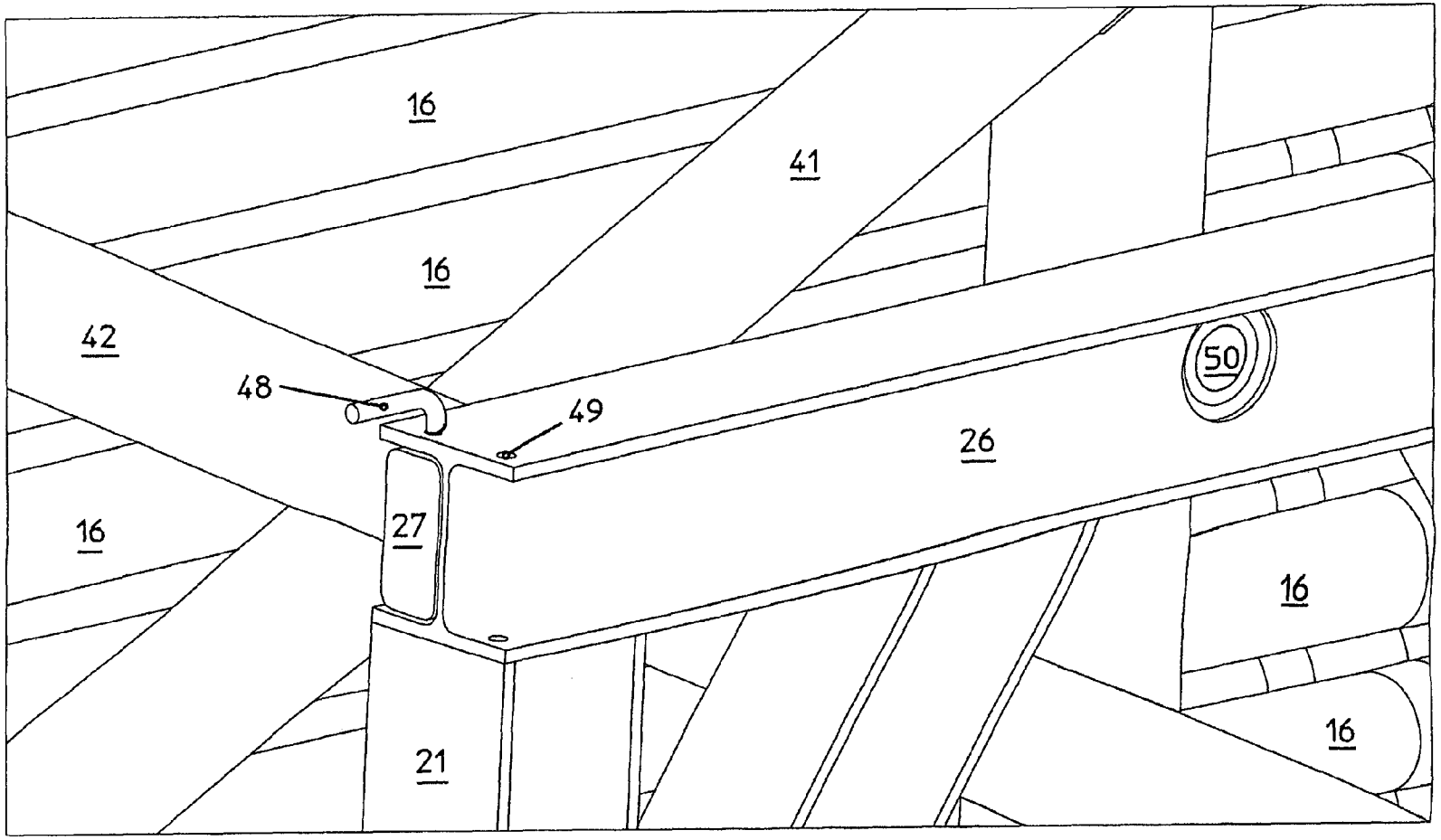
Figure 6:
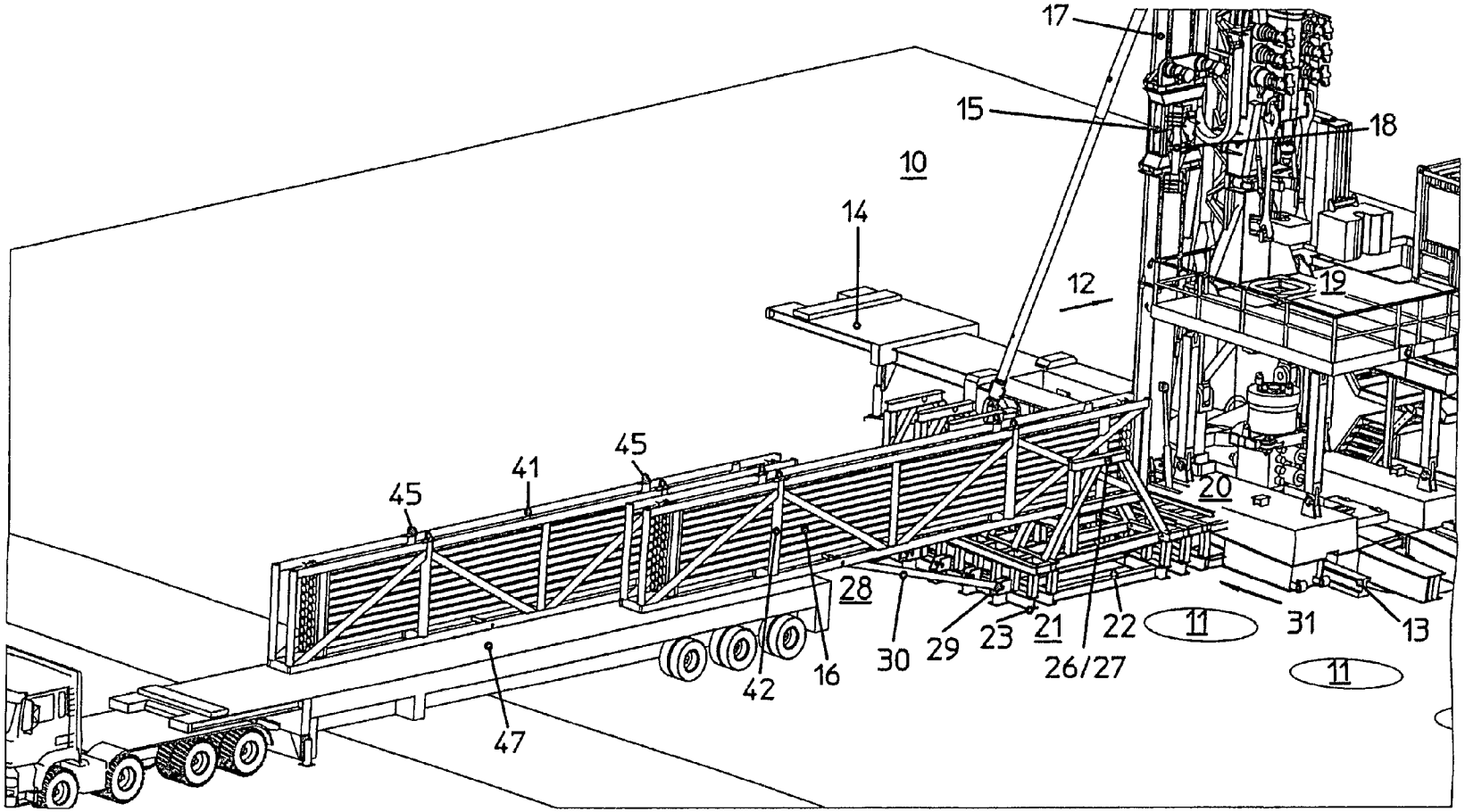
Figure 7:
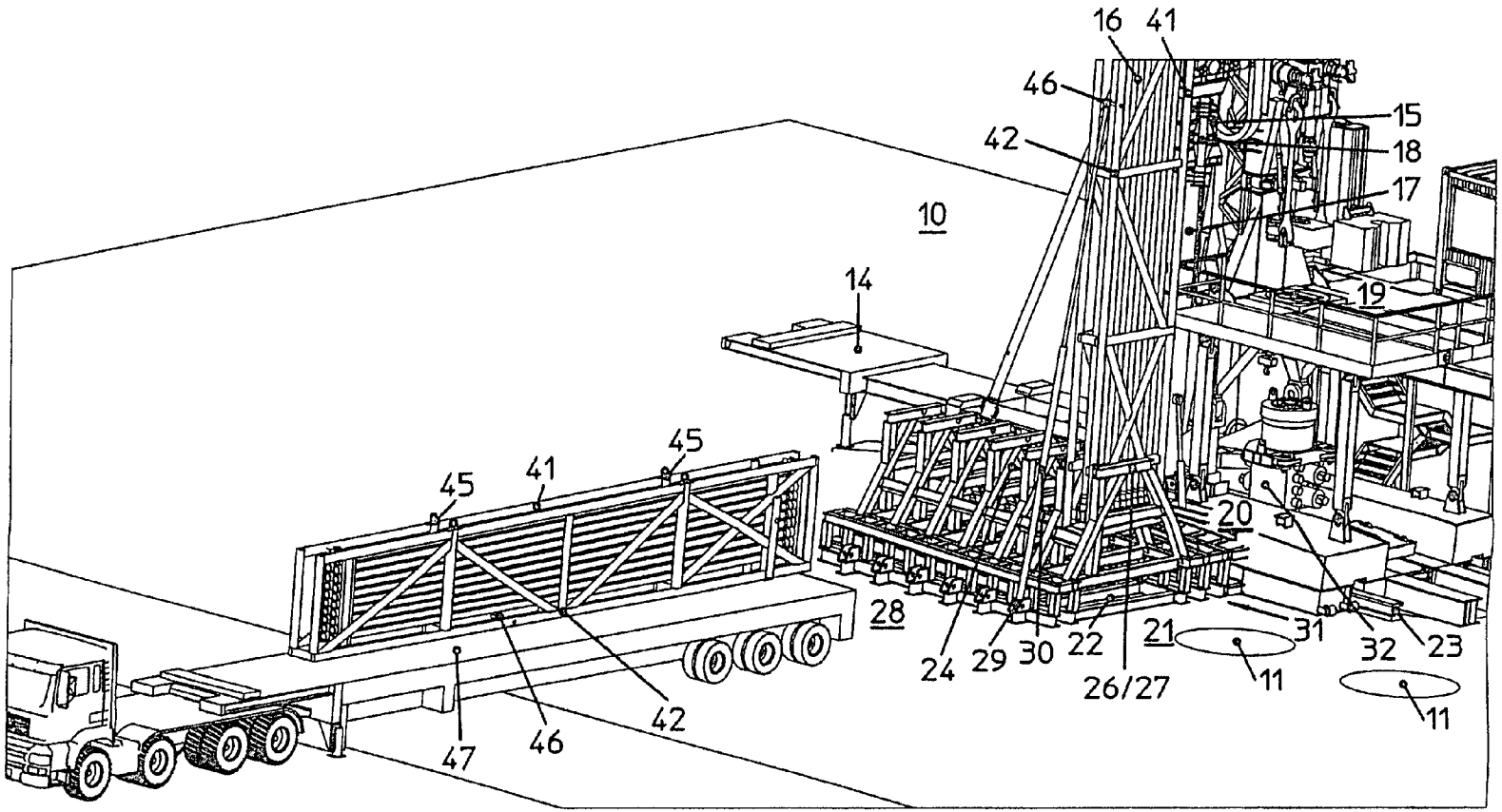

The transporting and storage framework 41 is supplied on a flat-bed truck 47. This is positioned such that the transporting and storage framework 41 arranged on it is aligned with an accommodating portion 24 of the pipe store 21 (FIG. 2). The transporting and storage framework 41 is then pushed into the accommodating portion 24 between the carrier structures 25. The arresting and rotary elements 27, each provided on the outside of the frame 42, are pushed into the accommodating means 26 here. This can be seen in FIGS. 3 to 5. If the arresting and rotary element 27 is located in the correct position in the accommodating means 26, as is illustrated in FIG. 5, an arresting means 48 is pushed into the arresting and rotary element 27, through an opening 49 in the accommodating means 26, and arrests said arresting and rotary element in relation to the accommodating means 26. The flat-bed truck 47 is then moved forward to the extent where the transporting and storage framework 41 is still resting on the flat-bed truck 47, but the accommodating means 46 on the underside of the transporting and storage framework 41 is accessible. A hydraulic cylinder 30 is attached between the accommodating means 46 and the accommodating means 29 on the basic body 22 of the pipe store 21. By virtue of the hydraulic cylinder 30 being extended, the transporting and storage framework 41 is rotated from the horizontal into the vertical about the point of rotation 50 of the arresting and rotary element 27 (see FIG. 7).

Thereafter, or at the same time, it is also possible for a plurality of transporting and storage frameworks 41 to be supplied to the pipe store 21. The operation of transporting away frameworks 41 which are no longer required, be this because they are empty and have to be replaced by new ones or be this because they are full on account of the drill rods being removed and have to be transported away, takes place in reverse order to the operation which has been described above.

Figure 8:
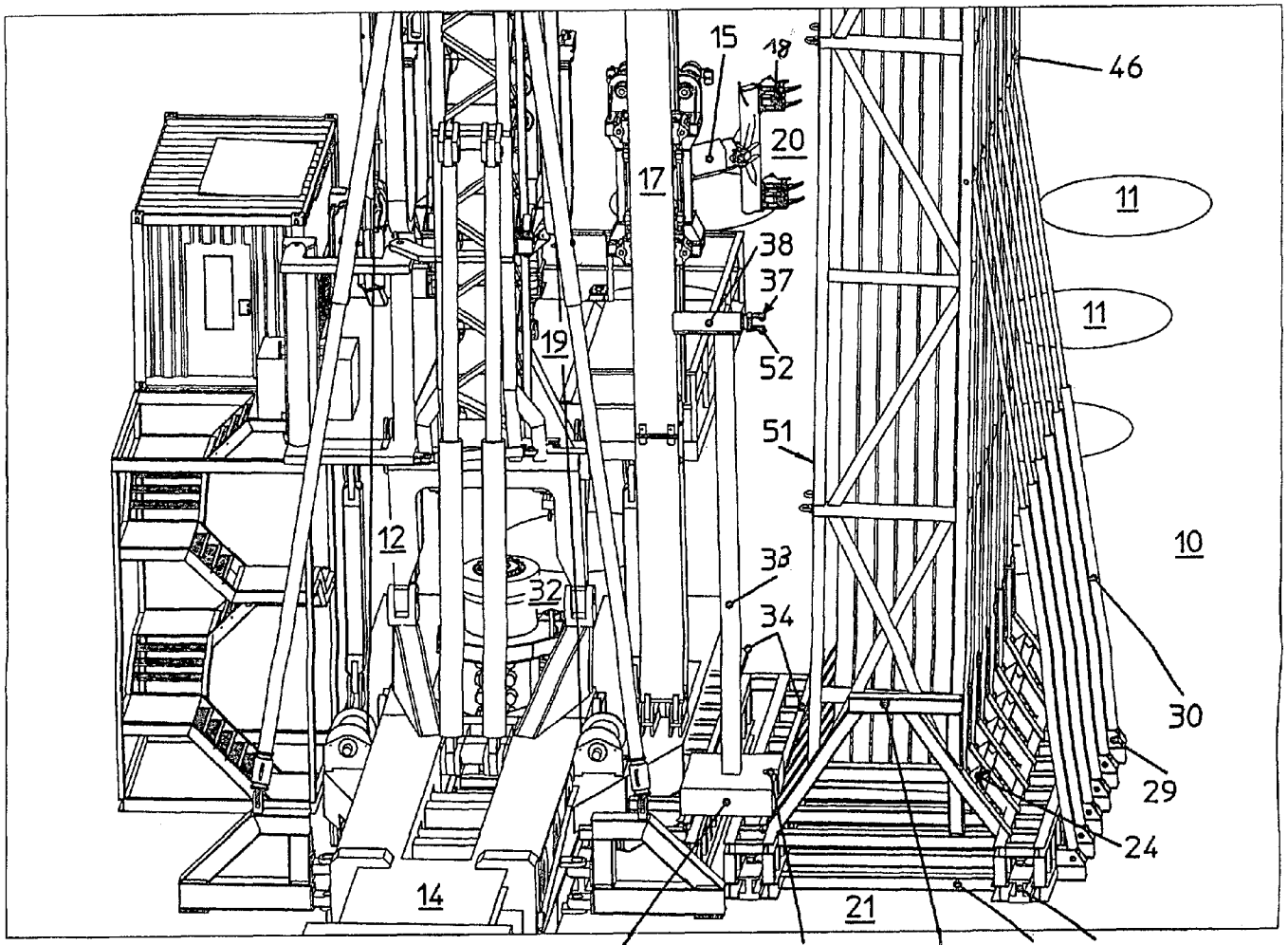

FIG. 8 illustrates a rear view of the drilling rig 12 with the pipe store 21. The pipe store 21 in FIG. 8 has six accommodating portions 24, each filled with transporting and storage frameworks 41 in a vertical arrangement. In order for it to be possible for the drill rods 16 to be removed from the transporting and storage frameworks 41, the arrangement elements 43 are prepared correspondingly such that the drill rods can be removed by a movement out of the transporting and storage framework 41 on the upper side 51 of the latter, said upper side, in the case of vertical orientation, being that side which is directed toward the drilling rig 12.

Figure 9:
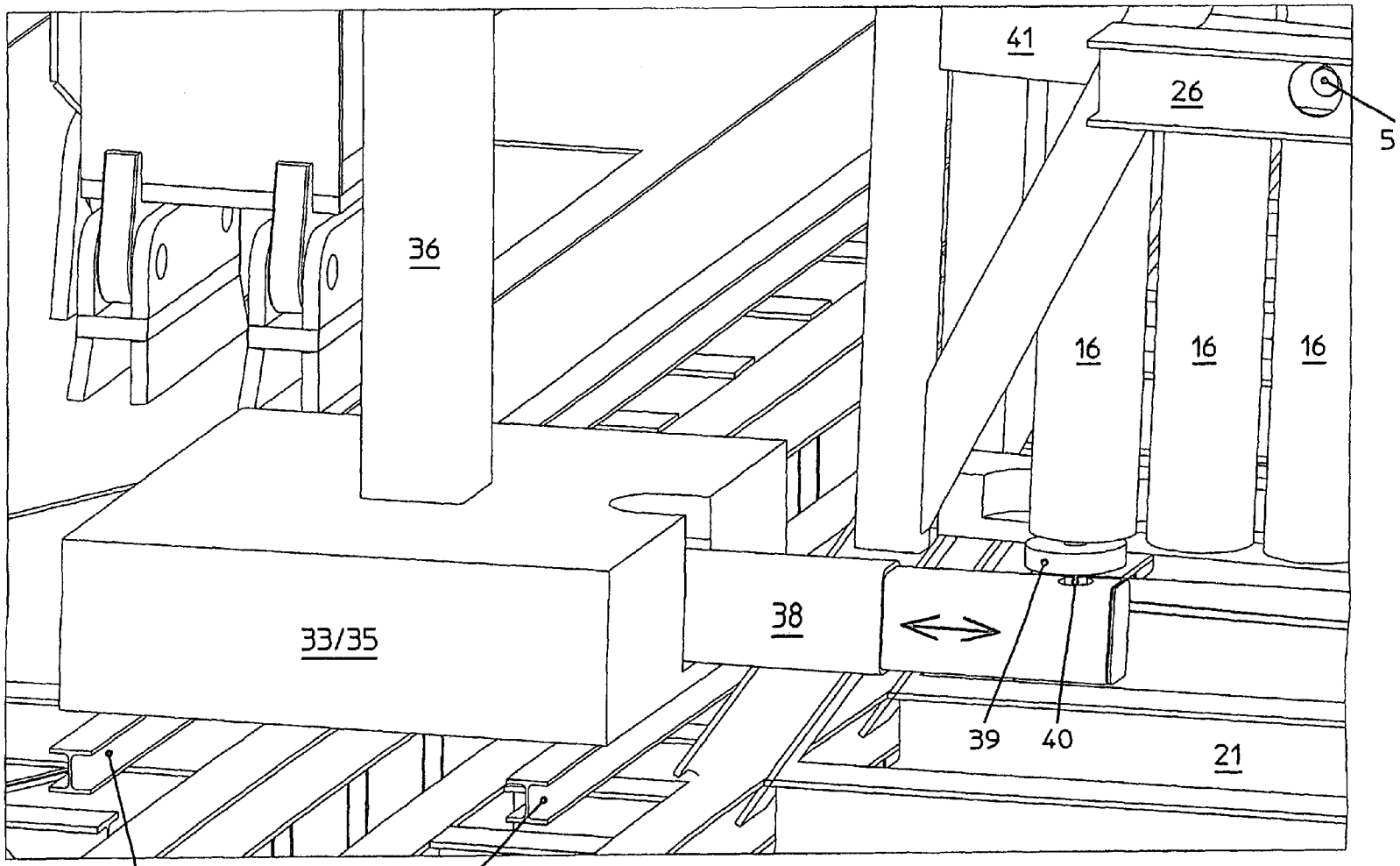
Figure 10:
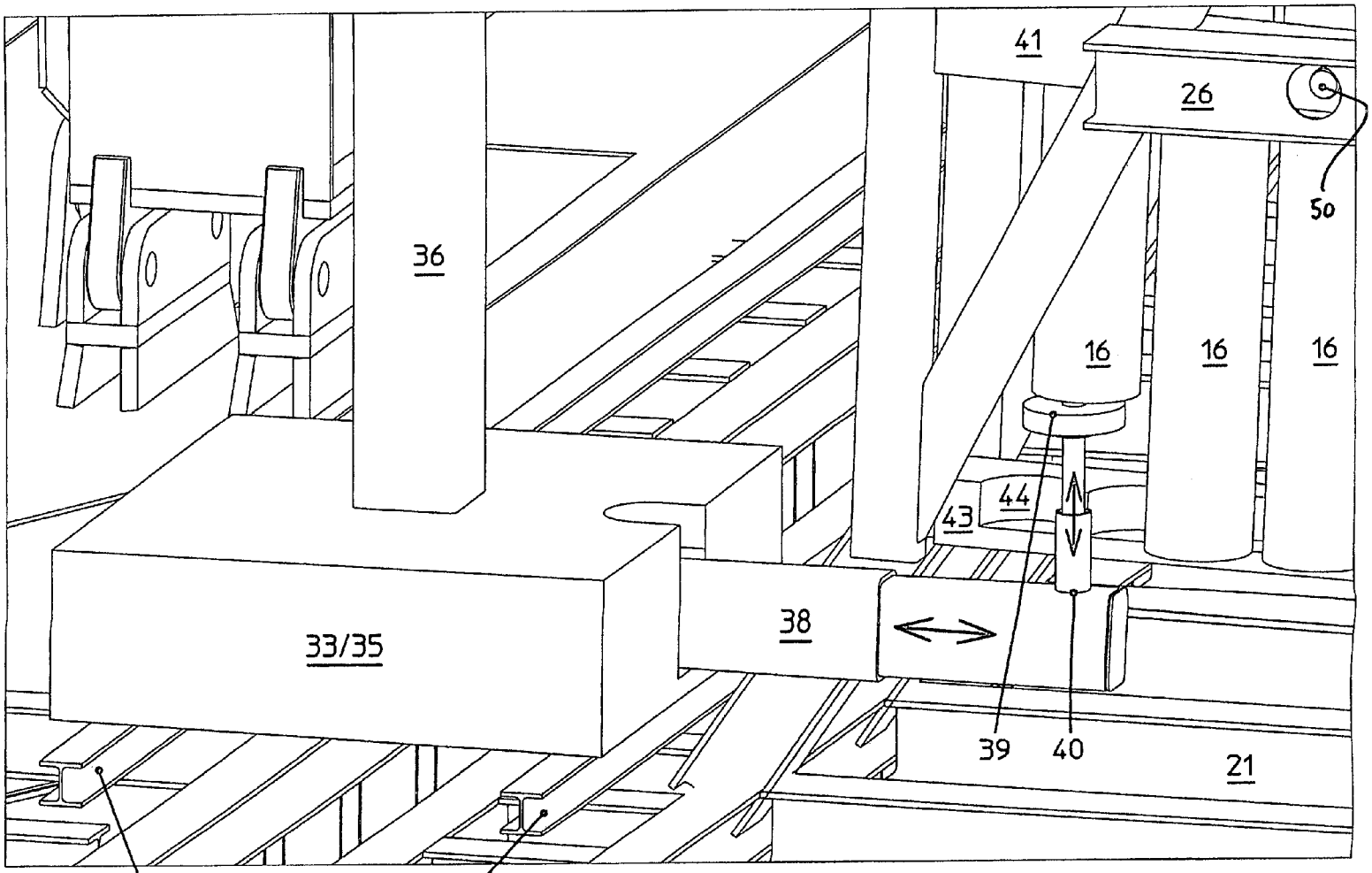
Figure 11:
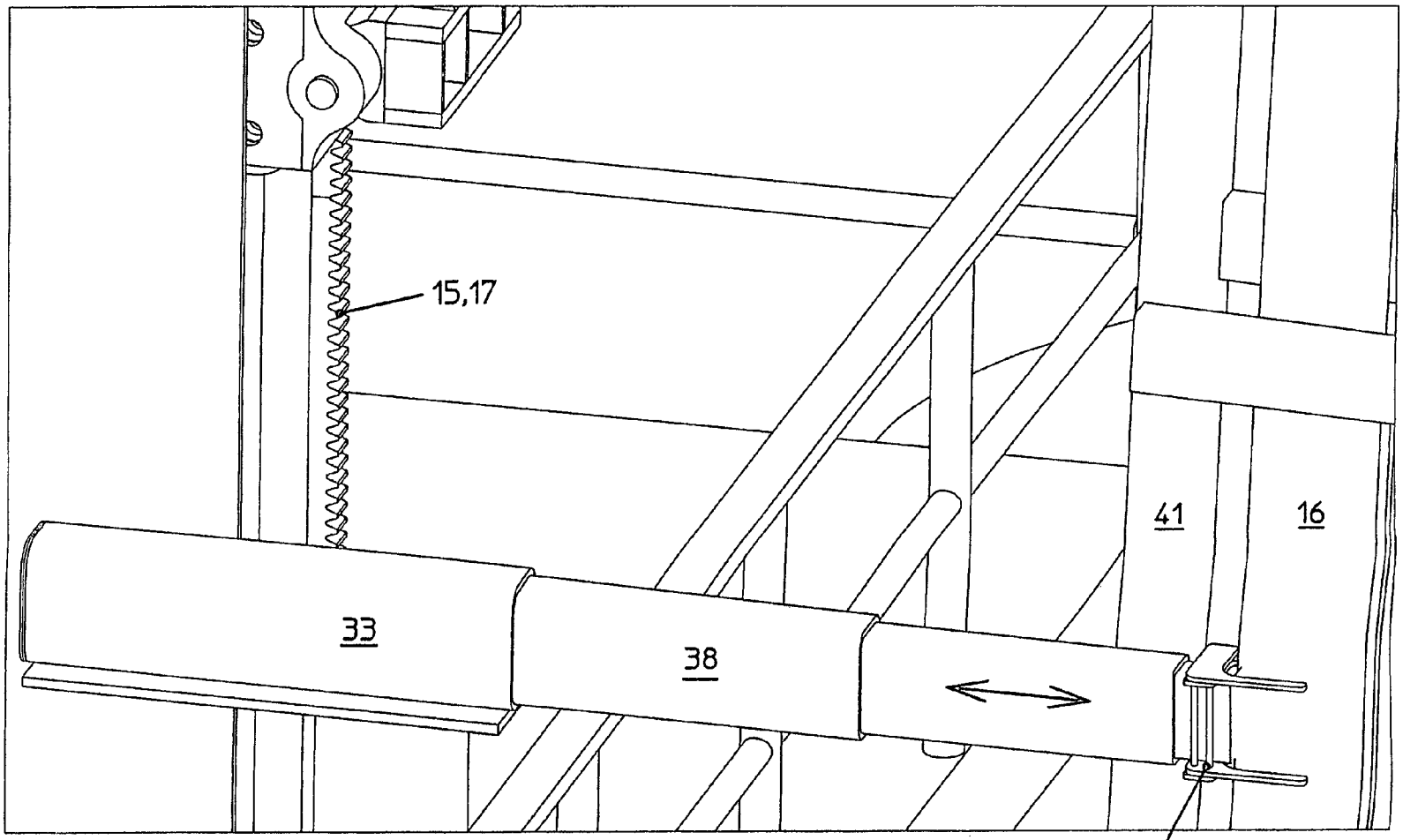

In order for the drill rods 16 to be removed from the transporting and storage framework 41, the removal apparatus 33 is moved in front of the accommodating portion 24 from which the drill rod 16 is to be removed. The base portion 35 contains within it a telescopic extension arm 38, which is extended horizontally beneath the lower end of the drill rod 16. At its outer end, the extension arm 38 has a removal element 39, which is designed such that it can establish a retaining connection with the lower end of the drill rod 16. By virtue of the hydraulic cylinder 40, which connects the removal element 39 to the extension arm 38, being extended, the drill rod 16 is raised and removed from the arrangement element, as is illustrated in FIGS. 9 and 10. The extension arm 38 is then retracted again and, at the same time, the drill rod 16 is moved out of the transporting and storage framework 41.

Figure 12:
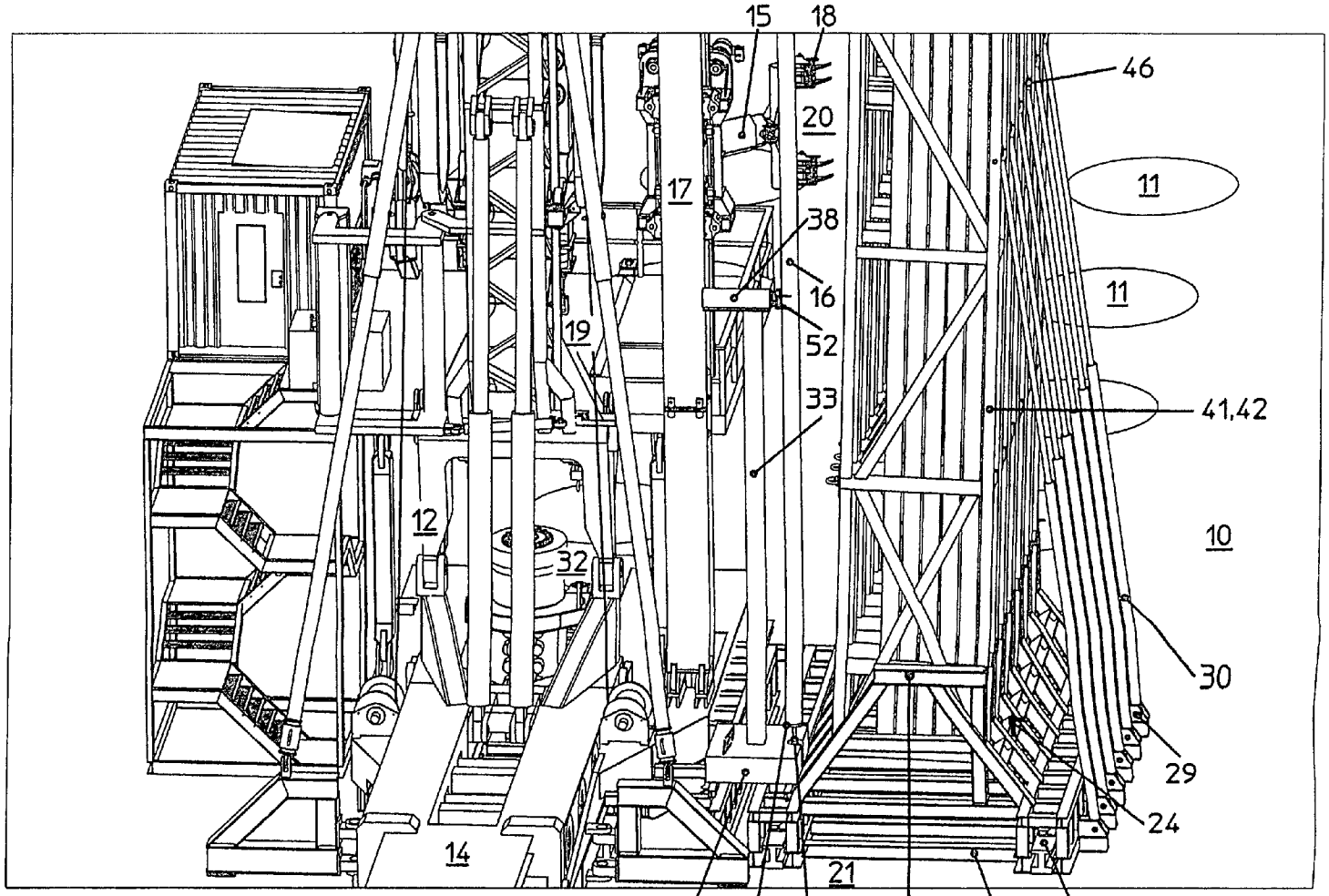
Figure 13:
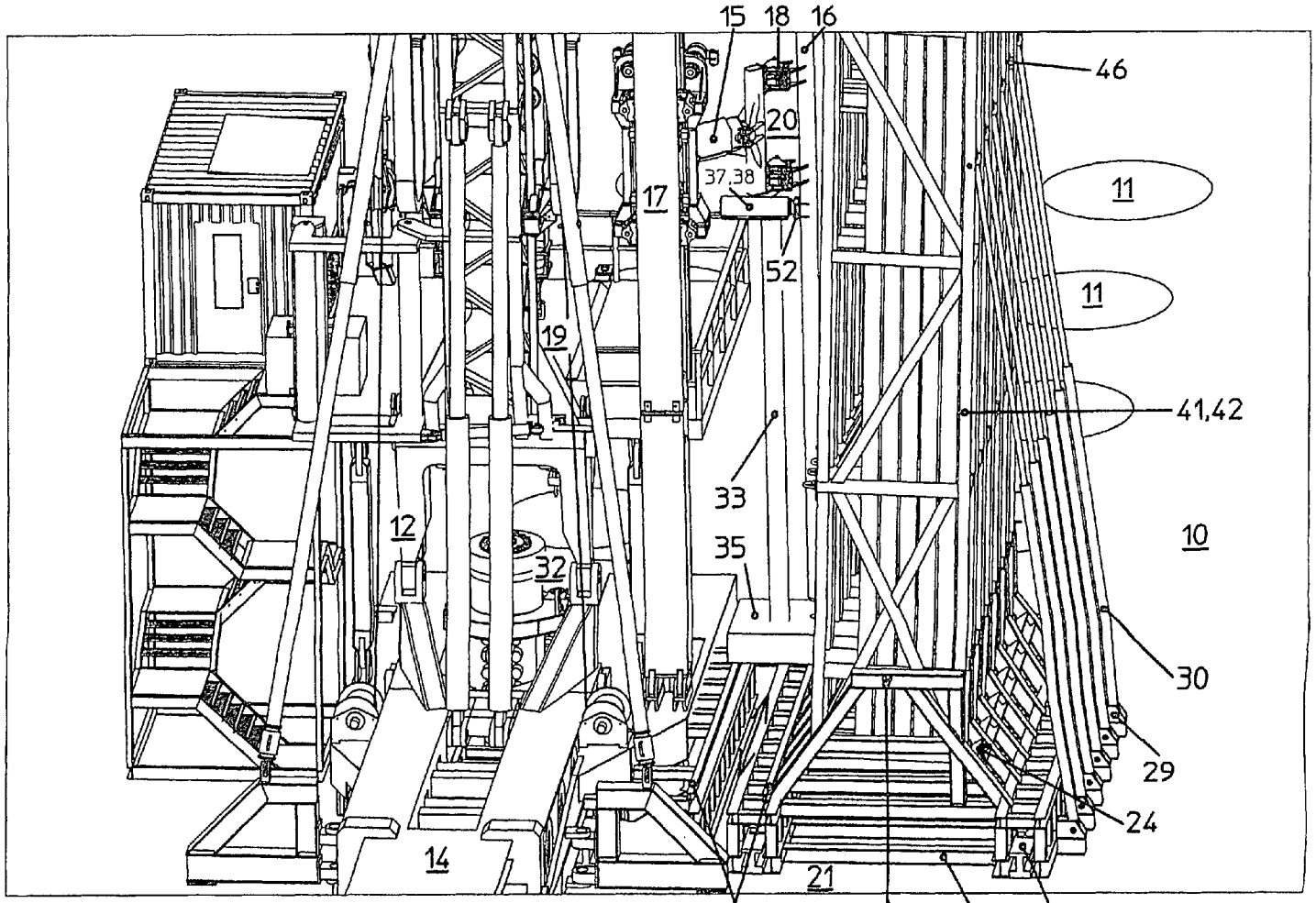

The base unit 35 has arranged on it a carrier 36, at the upper end of which a retaining element 37 is provided. The retaining element 37 likewise comprises an extension arm 38, which is of telescopic design. A gripping or retaining element 52 is provided at the end of the extension arm 38. Said gripping or retaining element engages around the drill rod 16 and ensures that, upon retraction of the extension arms 38, the drill rod remains in the removal apparatus 33. FIG. 12 illustrates the removed drill rod within the removal apparatus 33. The removal apparatus is then transported along the rails 34 to the transfer point 20, at which the pipe handler 15 then uses its gripping unit 18 to receive the separated drill rod 16 and transport it to the drilling region 19, for example by way of an upward movement and a pivoting movement. The transfer to the pipe handler 15 is illustrated in FIG. 13. The removal apparatus 33 then moves into the next accommodating portion 24 at which a drill rod 16 is to be removed.

For the method to progress and in order for the drill rod to be installed specifically, or for the sequence of the drill rods to be maintained, it is advantageous if the drills rods 16 are coded appropriately in logistical terms and if there is a control means (not illustrated) present to record and monitor the correct selection of the element which is to be installed or removed, so that the correct sequence of elements is ensured. This also relates to the installation of casing pipes into the drillhole.

The method described above makes it possible to achieve full automatic drilling advancement, since all the method steps described can be carried out in unmanned fashion. At the same time, it is possible to operate with a decentralized storage site for the transporting and storage frameworks 41, and therefore it is necessary to provide at the drilling site as such only a small amount of space for bringing the transporting and storage frameworks 41 in and transporting them away. As an alternative to using flat-bed trucks 47, it is also possible for these to be brought in and transported away by crane or helicopter.

In order to reach the next drilling site 11 at the drilling location 10, the drilling rig 12 can be made to skid together with the pipe store 21, which may likewise be completely filled with transporting and storage frameworks 41. There is no need, for this purpose, for a high-outlay operation for removing the drill rods 6.

| List of Designations | |
|---|---|
| 10 | Drillhole |
| 11 | Drilling site |
| 12 | Drilling rig |
| 13 | Rail |
| 14 | Flat-bed truck |
| 15 | Pipe handler |
| 16 | Drill rod |
| 17 | Carrier |
| 18 | Gripping unit |
| 19 | Drilling region |
| 20 | Transfer point |
| 21 | Pipe store |
| 22 | Basic body |
| 23 | Rail |
| 24 | Accommodating portion |
| 25 | Carrier structure |
| 26 | Accommodating means |
| 27 | Arresting and rotary element |
| 28 | Side |
| 29 | Accommodating means |
| 30 | Hydraulic cylinder |
| 31 | Side |
| 32 | Site of contact |
| 33 | Removal apparatus |
| 34 | Rail |
| 35 | Base portion |
| 36 | Carrier |
| 37 | Holder unit |
| 38 | Extension arm |
| 39 | Removal element |
| 40 | Hydraulic cylinder |
| 41 | Transporting and storage framework |
| 42 | Frame |
| 43 | Arrangement element |
| 44 | Depression |
| 45 | Lifting-means attachment |
| 46 | Accommodating means |
| 47 | Flat-bed truck |
| 48 | Arresting means |
| 49 | Opening |
| 50 | Point of rotation |
| 51 | Upper side |
| 52 | Gripping/retaining element |

The invention claimed is:

1. A pipe store for supplying and discharging pipe bodies, in particular drill rods, casing pipes, and/or drill-string parts, such as drill collars, drilling motors or the like, to and from a drilling rig for creating deep wells, having a basic structure, having at least one framework which is provided in the form of a transporting and storage framework for pipe bodies and in which a plurality of pipe bodies are arranged to form a load, and having a removal apparatus for removing the pipe bodies from the framework and supplying the pipe bodies into the framework, characterized in that the basic structure has at least two accommodating portions for accommodating the framework in an essentially horizontal arrangement, in that, following insertion into the accommodating portion, the framework is fastened in a rotatable manner therein, and can be transferred from a horizontal orientation into a vertical orientation by means of a lifting element, in that each of the pipe bodies can be individually removed from the framework, or inserted into the same, in the vertical position by the removal apparatus, and in that the removal apparatus can be displaced along the basic structure in front of the individual portions further characterized in that the removal apparatus can be displaced between an accommodating/discharging position in front of the accommodating portions and a transfer/receiving position for transferring the pipe body to a pipe handler or for receiving the pipe body from a pipe handler.

2. The pipe store as claimed in claim 1, characterized in that the lifting element is arranged with one side at the basic structure and the other side at the framework.

3. The pipe store as claimed in claim 1, characterized in that the removal apparatus has a vertically active lifting element, via which the pipe body can be raised, wherein the vertically active lifting element can be displaced preferably horizontally away from the removal apparatus.

4. The pipe store as claimed in claim 1, characterized in that the removal apparatus has a horizontally active retaining and/or gripping element, wherein the vertically active retaining and/or gripping element can be displaced preferably horizontally away from the removal apparatus.

5. The pipe store as claimed in claim 1, characterized in that an engagement region, in which the removal apparatus actively engages, is provided in the accommodating portion, beneath the framework.

6. The pipe store as claimed in claim 1, characterized by the provision of a control means, via which it is possible to control the removal or the addition of the pipe bodies, wherein preferably individual accommodating portions can be blocked by the control means.

7. The pipe store as claimed in claim 1, characterized in that the pipe store is arranged on rails and can skid with frameworks provided in the accommodating portions.

* * * * *